US005560855A

United States Patent [19]

Hinton et al.

[11] Patent Number: 5,560,855

[45] Date of Patent: Oct. 1, 1996

[54] METHOD OF TAGGING AND SUBSEQUENTLY INDENTIFYING REFRIGERANT LUBRICANTS

[75] Inventors: Michael P. Hinton, Neshanic Station, N.J.; Michael J. Denci, St. Charles, Ill.; Peter J. Heffron, Flemington, N.J.

[73] Assignee: Morton International, Inc., Chicago, Ill.

[21] Appl. No.: 496,942

[22] Filed: Jun. 30, 1995

[51] Int. Cl.[6] ..... G01N 21/64

[52] U.S. Cl. ..... 252/68; 252/964

[58] Field of Search ..... 252/68, 964, 301.19; 73/40

[56] References Cited

U.S. PATENT DOCUMENTS

| | | | |
|---|---|---|---|
| 4,209,302 | 6/1980 | Orelup | 44/59 |
| 4,758,366 | 7/1988 | Parekh | 252/68 |
| 4,904,765 | 2/1990 | Derber | 534/573 |
| 5,149,453 | 9/1992 | Parekh | 252/68 |
| 5,156,653 | 10/1992 | Friswell et al. | 44/328 |
| 5,205,840 | 4/1993 | Friswell et al. | 44/428 |
| 5,252,106 | 10/1993 | Hallisy | 44/328 |

*Primary Examiner*—Prince Willis, Jr.
*Assistant Examiner*—Cephia D. Toomer
*Attorney, Agent, or Firm*—Wayne E. Nacker; Gerald K. White

[57] ABSTRACT

A polyol ester or poly-alkylene glycol lubricant is tagged by adding to the lubricant a chemical marker which is stable over the temperature cycling range of a refrigerant.

In testing for the presence of the marker, a sample of a lubricant is obtained, and the sample is diluted in a sufficient volume of an organic solvent such that subsequent admixture with an aqueous solution will not result in emulsification. The diluted sample is extracted with an aqueous solution appropriate for the marker. Simultaneous with or subsequent to extraction, a chromophoric reaction of the marker is induced, whereby a readily identifiable color is observable.

2 Claims, No Drawings

METHOD OF TAGGING AND SUBSEQUENTLY INDENTIFYING REFRIGERANT LUBRICANTS

The present invention is directed to a method of tagging and identifying refrigerant lubricants, particularly lubricants used with hydro, chloro, fluoro carbons (HCFCs) and hydro fluoro carbons (HFCs).

BACKGROUND OF THE INVENTION

Until recently, chloro, fluoro carbons (CFCs) were used extensively for refrigeration. However, upon discovery of their adverse environmental effects, particularly with respect to depletion of the ozone layer, CFCs have become disfavored, and new refrigerants have been developed. In particular, HCFCs and HFCs have come into mandatory use. While these refrigerants are chemically similar to CFCs and are not totally environmentally benign, they are much less harmful to the ozone layer.

In conjunction with HCFC and HFC refrigerants, lubricants are required for refrigeration apparatus maintenance. In the past, with CFC refrigerants, mineral oil or simple alkyl benzenes were used as lubricants. When HCFCs or HFCs became mandated, it was found that the old lubricants were not compatible with either HCFCs or HFCs. In addition, corrosion inhibitors and antioxidants started to be used, further extending the requirements of the lubricants. To satisfy these requirements, polyol esters and poly-alkylene glycol (PAG) lubricants were developed and have become the standard lubricants for the new HCFS. Such lubricants are typically used in amounts in the range of 1% by weight relative to the HCFC or HFC refrigerants. The particular formulation of an HCFC/HFC lubricant is often proprietary. The lubricants may vary widely in both cost and effectiveness. Accordingly, a manufacture of refrigeration apparatus may require that the apparatus be maintained using a particular type of lubricant when recharging the apparatus with refrigerant, or a service contract may call for a particular lubricant to be used in recharging apparatus.

Furthermore, refrigeration apparatus is very expensive to install. Lubricants for old (CFC) systems are incompatible with the new (HCFC/HFC) systems; thus a need to tag lubricants for the new systems and be able to identify any dilution of new lubricants with old lubricants.

In some cases, use of old CFC refrigerants are permitted in older refrigeration systems which cannot utilize the newer HCFC/HFC systems. This means that the older CFC refrigerants may be available for a limited time. While CFC refrigerants should not be used in the newer refrigeration systems designed for HCFC/HFC use, the older CFC refrigerants are much cheaper than the HCFC/HFC refrigerants, and there may be a strong temptation to misuse CFC refrigerants by recharging a HCFC- or HFC-compatible system with CFC refrigerants. To prevent this, CFCs might be tagged with an identifiable marker. If misused in an HCFC- or HFC-compatible system such markers will be mixed in the residual polyol ester or PAG lubricants from the initial HCFC/HFC charge, from which they can be identified.

It would be desirable to have a simple, straight-forward test to determine whether a particular lubricant has, in fact, been used when charging or recharging refrigeration apparatus. The lubricants, however, while sufficiently different from each other to function with varying effectiveness, are sufficiently similar as not to be easily distinguished by simple chemical tests.

It is possible to dye lubricants; however, fluorescent dyes are generally added to refrigeration systems for leak detection purposes, and it is therefore undesirable to add a second dye which could mask the fluorescence.

Petroleum fuels are often tagged for the purpose of identifying grades or tax category. Markers for the tagging of petroleum fuels are described for example, in U.S. Pat. Nos. 4,209,302, 4,904,765, 5,156,653, 5,205,840,and 5,252,106, the teachings of each of which is incorporated herein by reference. The markers used for tagging petroleum fuel are intended to be silent, i.e., provide no significant coloration to the petroleum fuel. They may be naturally colorless or insignificantly colorful at the concentrations used in tagging petroleum, or they may be used in conjunction with dyes which mask any color the marker may impart. Such markers, however, are extractable with aqueous solutions, which depending upon the marker may be acidic, basic, and/or may contain an alcohol. The markers also are capable of undergoing a chromophoric change to produce an intense color, such as by reaction with the acid or base of the aqueous solution or with another chemical reagent which may be included in the extracting aqueous solution or subsequently added thereto.

Herein, a method is provided for tagging and identifying refrigeration lubricants using silent markers, such as those in the patents referenced above.

SUMMARY OF THE INVENTION

In accordance with one aspect of the invention, there is provided a method of tagging and identifying a polyol ester lubricant or poly-alkylene glycol (PAG) lubricant comprising tagging lubricant with a marker which is extractable from a water-immiscible solvent by an aqueous solution and which is capable of undergoing a chromophoric reaction to produce a readily visible color, obtaining a sample of lubricant to be identified, dissolving the lubricant in an organic solvent to produce an extractable solution, extracting the marker from the extractable solution with an aqueous solution, and simultaneously or subsequent to the extraction, inducing the chromophoric reaction, the volume of organic solvent in which said lubricant is dissolved in the dissolving step being sufficient to provide a clear phase separation without emulsification.

In accordance with another aspect of the invention there is provided a method of identifying a marker in a composition which contains a polyol ester lubricant or a polyalkylene glycol lubricant, the marker being extractable from a water-immiscible solvent by an appropriate aqueous solution and the marker being capable of undergoing a chromophoric reaction to produce a readily visible color. The composition in question is dissolved in an organic solvent to produce an extractable solution. The marker is extracted from the solution with an appropriate aqueous solution, and simultaneously or subsequent to the extraction, the chromophoric reaction is induced.

DETAILED DESCRIPTION OF CERTAIN PREFERRED EMBODIMENTS

It was attempted to add petroleum markers to polyol ester and PAG lubricants in refrigeration systems and to extract and identify the same in the manner that such markers are added to petroleum fuels and extracted and identified. However, these attempts were less than successful due to the fact that the polyol ester and PAG lubricants, though not miscible with the aqueous phase, tend to form an emulsion with the aqueous phase. While such emulsion may or may not be stable, the emulsion is sufficiently long-lasting that it interferes with a rapid reading of the test.

In accordance with the invention, it is found that if the lubricant which is being evaluated is initially dissolved in a water-immiscible solvent, such as isooctane, the dye can be extracted and identified without emulsification. The amount of solvent necessary to prevent emulsification may vary depending upon the particular lubricant and the particular solvent, but typically at least about a 1:1 dilution by volume is required. For convenience 2:1 to 3:1 and upward dilutions may be used. In addition to isooctane, a wide variety of water-immiscible organic solvents may be used to dilute the lubricant, including, but not limited to hexane, heptane, benzene, toluene, xylene, ethyl acetate, cyclohexane, petroleum ether and mixtures of such organic solvents.

Some of the markers known in the art may be identified at extremely low levels, e.g., as low as 0.1 parts per million by weight in the lubricant. However, higher amounts may be used, particularly if it is desirable to quantify the amount of marker and thereby determine whether there has been a dilution of the prescribed lubricant. For cost efficiency, it is uncommon to add marker at greater than about 100 ppm. In the usual case, the marker will be added to the lubricant by the manufacturer of the lubricant, although other scenarios may be envisioned.

In testing for the particular lubricant, a specimen of the refrigeration/lubricant mixture is taken. Although the refrigerant is of a much greater volume than the lubricant, much of the refrigerant flashes off when no longer maintained under pressure, leaving the lubricant available for testing. A given volume of the lubricant is then admixed with a given volume of water-immiscible organic solvent, as discussed above.

Next, the marker is extracted with an aqueous solution, and simultaneous with or subsequent to extraction, a chromophoric reaction is induced, causing the marker to be readily identified. The particular type of aqueous solution used for extraction depends upon the type of marker which is added. Some markers, such as those described in above-referenced U.S. Pat. Nos. 5,205,840 and 5,252,106 are extractable with basic aqueous solutions and undergo a chromophoric change in the presence of base. Other markers, such as those described in above-referenced U.S. Pat. No. 4,904,756 are extractable in acidic aqueous solutions and undergo a chromophoric reaction in the presence of acid. Above-referenced U.S. Pat. No. 5,156,653 teaches markers extracted by aqueous solution which produce colors upon simultaneous or subsequent reaction with amine. U.S. Pat. No. 4,209,302 discusses markers extractable with acidic aqueous solutions which produce a color when coupled to stabilized diazo reagents.

The markers in the references discussed above are designed to produce intense colors which, even with a small amount of marker, provide an intense color readily observable with the naked aye. To a greater or lesser degree, the colorimetric reactions are generally quantitative, and relatively precise estimates of marker concentrations may be obtained using chromographic apparatus.

All of the markers in the references discussed above are extractable from organic solvent solutions of the polyol ester and PAG lubricants including being extractable from fluorescent dyes commonly used in conjunction with such polyol ester and PAG lubricants for leak detection. The fluorescent dyes are not extracted and remain in the organic phase.

Markers for refrigerant lubricants must withstand temperature extremes. Refrigerant lubricants will typically be at low temperatures, e.g., as low as about −40° C., but may be temporarily cycled at temperatures at up to 250° C. The markers described in the above-referenced patents generally have sufficient stability over the operating temperature ranges for refrigerant lubricants.

The markers that are identified might be those added to a charge of HCFC or HFC refrigerant lubricant. Alternatively, the markers added to older CFC refrigerants and admixed with HCFC or HFC refrigerant lubricants through wrongful mixing of the refrigerants may be identified. It may be useful, in fact, to utilize markers extractable with one type of aqueous extraction system with CFC lubricants and another type of markers extractable with another type of aqueous system with HCFC or HFC lubricants, e.g., acid-extractable in one system and base-extractable in another system.

The invention will now be described in sufficient detail by way of specific examples.

EXAMPLE 1

Mobil polyol ester lubricant was marked with 60 ppm of 4-(4-nitrophenyl azo)-2,6-(di sec butyl) phenol.

One part of this marked lubricant was then diluted with 2 parts isooctane. This dilute solution was then extracted with a solution of methoxy ethoxy propylamine, water and glycol to give the characteristic blue color indicative of the presence of the marker. Two parts of a diluted lubricant was extracted with 1 part of the extractant.

EXAMPLE 2

Mobil polyol ester lubricant was marked with 60 ppm of 4-[3-(1-naphylamino)-propyl] morpholine.

One part of this lubricant was then diluted with 2 parts xylene. 20 cc of this solution was extracted with a solution of drops of a stabilized 2-chloro aniline diazo solution in 10 cc 4 of an acetic acid/water/ammonium hydroxide solution.

The characteristic red color confirmed the presence of the marker.

EXAMPLE 3

This example was the same Example 1 except the initial lubricant was dosed at 6 ppm.

Resultant light blue extractant color confirmed the presence of the marker.

EXAMPLE 4

This example was the same as Example 2 except the initial concentration of marker in the lubricant was 1 ppm.

Bright red color proved the presence of the marker.

EXAMPLE 5

The lubricant described in Example 1 was treated with 40 ppm of Solvent Yellow 124.

Dilution of one part of the marked lubricant with 3 parts isooctane followed by extraction with 50% hydrochloric acid gave the characteristic red color in the lower aqueous phase.

EXAMPLE 6 and 7

These examples were the same as Examples 1 and 2 except UCON refrigerant lubricant RO-O-1652 (Union Carbide), a PAG, was used. Results showed identical blue extract for the marker used in Example 1 and red extract for the marker shown in Example 2.

EXAMPLE 8

This example was the same as Example 1 except 4-(3,4-dichloro phenyl azo)-2, 6-di sec butyl phenol was used as the marker. Extraction was done using 20 cc of a solution of water, caustic and methoxypropylamine with 10 cc of diluted marker lubricant.

What is claimed is:

1. A method for tagging a polyol ester or poly-alkylene glycol lubricant and identifying the same, the method comprising a) adding to said lubricant a chemical marker capable of undergoing a chromophoric reaction and which is stable over the temperature cycling range of a refrigerant, b) obtaining a sample of lubricant, c) diluting said sample in a sufficient volume of an organic solvent such that subsequent admixture with an aqueous solution will not result in emulsification, d) extracting said diluted sample with an aqueous solution appropriate for said marker, and e) simultaneous with or subsequent to d) said extraction step, inducing a chromophoric reaction of said marker, whereby a readily identifiable color is observable.

2. A method for identifying a marker in a composition containing a polyol ester or poly-alkylene glycol lubricant, the marker being extractable from the composition with an appropriate aqueous solution and being able to undergo a chromophoric reaction, the method comprising a) obtaining a sample of said lubricant-containing composition, b) diluting said sample in a sufficient volume of an organic solvent such that subsequent admixture with an aqueous solution will not result in emulsification, c) extracting said diluted sample with an aqueous solution appropriate for said marker, and d) simultaneous with or subsequent to c) said extraction step, inducing a chromophoric reaction of said marker, whereby a readily identifiable color is observable.

* * * * *